US005829737A

United States Patent [19]

Gersemsky

[11] Patent Number: 5,829,737

[45] Date of Patent: Nov. 3, 1998

[54] ROPE GUIDE FOR A WINCH HAVING TWO INTERCONNECTED DRIVABLE ROPE GUIDES

[75] Inventor: Udo Gersemsky, Herdecke, Germany

[73] Assignee: Mannesmann Aktiengesellschaft, Düsseldorf, Germany

[21] Appl. No.: 833,392

[22] Filed: Apr. 8, 1997

[30] Foreign Application Priority Data

Apr. 19, 1996 [DE] Germany ..... 196 17 098.2

[51] Int. Cl.[6] ..... B66D 1/38

[52] U.S. Cl. ..... 254/278; 254/285; 254/336

[58] Field of Search ..... 254/285, 284, 254/286, 336, 337, 389, 278; 242/397.1, 388.6

[56] References Cited

U.S. PATENT DOCUMENTS

| | | | |
|---|---|---|---|
| 1,524,198 | 1/1925 | Morgan | 254/285 |
| 2,238,398 | 4/1941 | Reed | 254/389 |
| 2,347,885 | 5/1944 | Crickmer | 254/389 |
| 2,738,143 | 3/1956 | Hannay | 242/397.1 |
| 2,984,455 | 5/1961 | Rischer | 254/286 |
| 3,215,405 | 11/1965 | Walsh | 254/389 |
| 3,226,090 | 12/1965 | Sauerbrey | 254/284 |
| 3,866,718 | 2/1975 | Hiergeist | 242/388.6 |
| 3,877,660 | 4/1975 | Bernard | 242/388.6 |

FOREIGN PATENT DOCUMENTS 42 41 655 4/1994 Germany .

*Primary Examiner*—Katherine Matecki
*Attorney, Agent, or Firm*—Cohen, Pontani, Lieberman & Pavane

[57] ABSTRACT

A rope guide for a winch including a rotatably supported winding drum defining an axis of rotation and having helical cable or rope grooves defined about the drum periphery and which spiral inward from the drum distal edges toward the drum center. Two guide elements are provided to align a corresponding pair of rope lines as the lines are wound onto and from the rotating winding drum. Coupling means affixed to the guide elements movably connect the guide elements for movement along the tracks of an elongated rail and parallel to the axis of rotation of the winding drum as the rope lines are wound onto and from the drum. The coupling means are constructed as longitudinal coupling supports that are concurrently movable in opposite directions longitudinally along the rail and are guided in the respective tracks and supported at at least two spaced apart points. The combination of each longitudinal coupling support and guide element is preferably guided and supported via the guide element in different tracks.

11 Claims, 5 Drawing Sheets

ROPE GUIDE FOR A WINCH HAVING TWO INTERCONNECTED DRIVABLE ROPE GUIDES

BACKGROUND OF THE INVENTION

1. Field of the Invention

The present invention relates to a rope guide for a winding mechanism or winch, and more particularly to a rope guide including a winding drum and having guide elements which are movable parallel to the axis of rotation of the winding drum on at least one rail and which align at least a pair of rope lines as they are wound onto and from the winding drum.

2. Description of the Related Art

Rope guides of this general type are commonly used on winches, particularly those having winding drums in which rope grooves are defined in order to prevent the hoisting rope from exceeding a permissible lateral deflection or displacement along the axis of rotation of the winding drum; these deviations or deflections may occur, for example, as a result of a pendulum-like swinging of the load or due to lateral or diagonal tension on the rope. Experience has demonstrated that a reduction in the deflections resulting from the latter leads to increased service life of the rope.

German Patent No. DE 42 41 655 C1 discloses a generic rope guide in which a rail, including the guide elements, is swivelably suspended in the immediate vicinity of the points at which the rope lines run off tangentially from the winding drum. This makes it possible to substantially adapt the swiveling movement of the rail, including the guide elements, to the deflecting movement of the rope lines transverse to the axis of rotation of the winding drum, and enables particularly gentle guidance of the rope lines without additional driving means. The rail has two tracks which are arranged in spaced relation one above the other in the form of laterally open channels, each track guiding a guide element. The tracks are provided with grooves extending in the longitudinal direction of the rail for sliding shoulders guided therein. The relatively extensive length of the sliding shoulders, which is required for their stable guidance within the track grooves, limits the compactness of the device. The sliding shoulders also provide a supporting action and serve to transmit forces to the rail via the guide elements. In particular, the guide elements cannot move over the entire length of the rail in this rope guide.

SUMMARY OF THE INVENTION

It is accordingly an object of the present invention to provide a rope guide for a winch, in particular for hoisting gear, which operates without additional, separate driving means and which enables a gentle winding and unwinding of the rope when the rope is under lateral or diagonal tension. The present invention also provides a rope guide that is advantageously compact and relatively maintenance free.

The rope guide of the present invention includes a winding drum having substantially helical rope or cable grooves that extend in opposite axial directions along the drum surface and that are defined about the drum periphery. The winding drum is rotatably supported in a frame and defines an axis of rotation. Two guide elements are provided for the alignment of at least one pair of rope lines in relation to the rope grooves about the winding drum. The guide elements are movable parallel to the axis of rotation on at least one rail, and are movably connected to each other via coupling means that are affixed to the guide elements. The guide elements are movable via the coupling means in relatively opposite directions, and are drivable (caused to move) as the rope lines are wound onto and from the winding drum. The rail has at least two vertically stacked tracks that extend longitudinally therewith and which are arranged in spaced apart parallel relation, and within which the guide elements are guided and supported. The coupling means comprise longitudinal coupling supports that are guided in one of the tracks and supported along the track at at least two spaced apart points, a guide element being rigidly connected to an end of each longitudinal coupling support. Thus, a longitudinal coupling support and guide element, in combination, form a unit which is movable along the longitudinal extension of the rail and is supported at at least four points; the guide element and longitudinal coupling element are each supported at two points and the spacing between the support points can be relatively large. The rigidly connected unit formed of the longitudinal coupling support and guide element is preferably guided and supported via the guide element in different tracks, and the support and guidance of the unit are appreciably enhanced by the longitudinal coupling support. The relatively extensive selected spacing of the support points of the longitudinal coupling support results in excellent horizontal stabilization of the guide element which effectively prevents jamming of the guide element even in the presence of considerable rope forces. Moreover, the rope guide according to the present invention can be constructed in a very compact manner, and the inventive construction enables the guide elements to move over the entire length of the rail.

The longitudinal coupling supports are advantageously constructed as toothed racks that engage a toothed wheel which is supported in the rail for unimpeded rotation and which connects the longitudinal coupling supports. This permits movement of the guide elements in opposite directions in a very simple manner.

A pin for the toothed wheel can be loosely and virtually effortlessly inserted into an opening provided in the rail to fix the longitudinal coupling supports arranged in the tracks in virtually any position relative to one another.

Each longitudinal coupling support is preferably supported proximate its opposite ends in the track via running wheels or rollers that are horizontally supported for free rotation. The thereby-permitted large spacing between the running wheels ensures very good horizontal stabilization of the guide element, and the use of running wheels or rollers ensures smooth running of the guide element.

In addition, in order to improve the guidance and support of the guide element, each longitudinal coupling support is guided at its end remote from the guide element by a vertically supported and freely rotatable support roller.

The guide elements are thus reliably guided and supported since each guide element is supported in the tracks which are arranged one behind the other in the direction of the rope lines by way of two support rollers arranged at the guide element. The tracks themselves advantageously form support surfaces in their cross-sectional base and/or at the side surfaces thereof.

The tracks are also advantageously provided with holding elements and support surfaces which form respective vertically and horizontally arranged support surfaces and/or running surfaces extending in the longitudinal direction of the rails. These ensure trouble-free guiding and supporting of the guide element within the rail.

In an alternative embodiment of the invention, the running wheels and support rollers are replaced at least partially by sliding elements to provide a rope guide that is particularly resistant to soiling.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
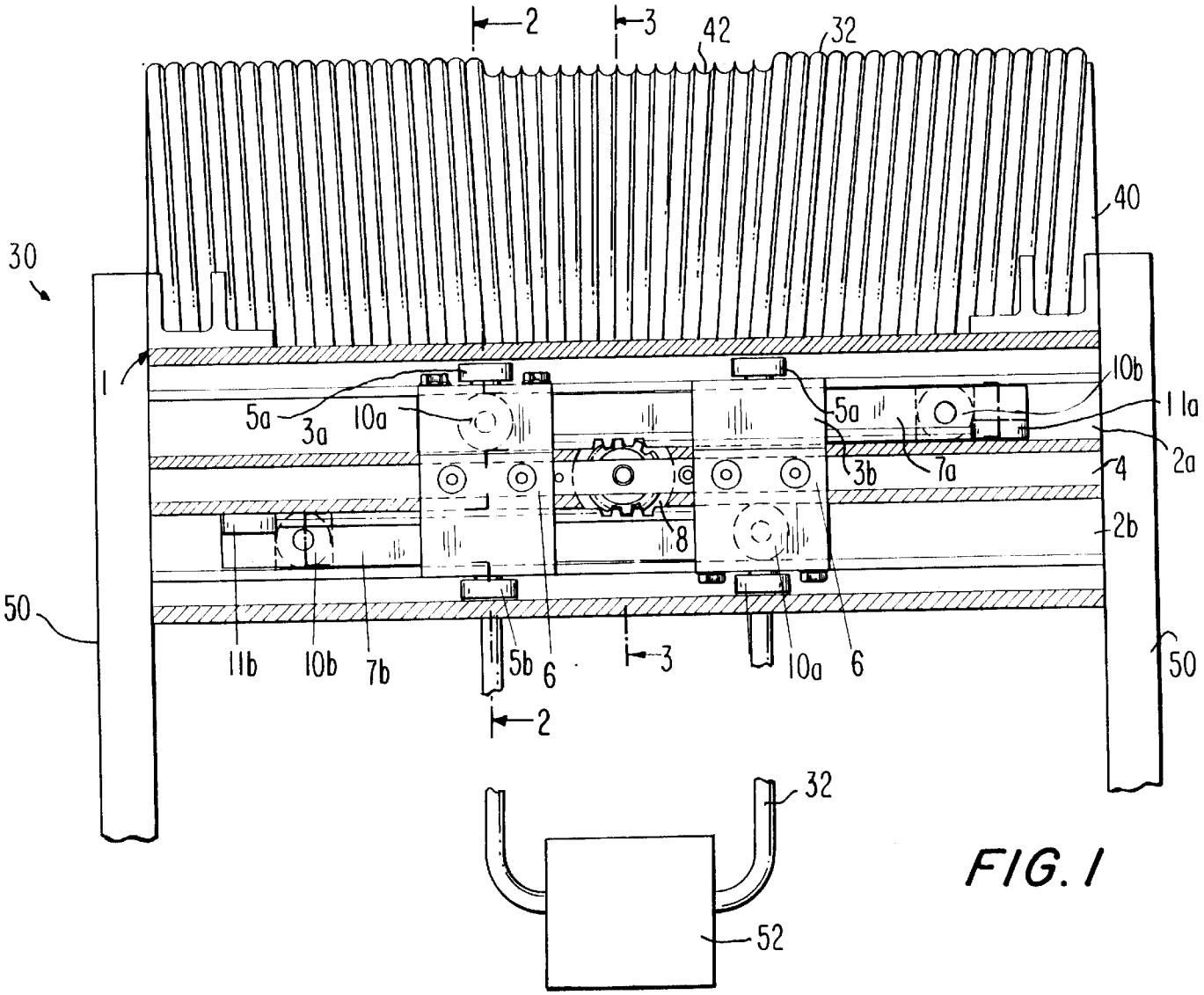
FIG. 1 is a front view of a rail with two guide elements, each guide element being rigidly connected with a longitudinal coupling support configured as a toothed rack in accordance with the present invention.

FIG. 1 shows a rope guide of a hoist mechanism 30 configured in accordance with the present invention and having a winding drum 40 rotatably supported in a frame 50. The winding drum 40 defines an axis of rotation and preferably includes helical grooves or channels 42 which spiral respectively inward from the distal edges of the winding drum 40 toward the center of the drum 40. The grooves 42 are arranged about the periphery of the winding drum 40 and configured for accepting a pair of cables or rope lines 32 as they are wound onto and from the winding drum 40. A block 52 may be connected to the cables or rope lines 32 for vertical movement as the cables or rope lines 32 are wound onto and from the drum 40.

The rope guide 30 includes a rail 1 extending substantially parallel to the drum axis, having at least two tracks 2*a*, 2*b* that extend longitudinal therealong and which are arranged in substantially vertically stacked, parallel relation. The tracks 2*a*, 2*b* are configured as laterally open channels that are vertically spaced apart from one another and serve to guide two selectively movable guide elements 3*a*, 3*b*, the tracks 2*a*, 2*b* being connected to one another by a web 4 (see also FIG. 2). The guide elements 3*a*, 3*b* serve to align each of the pair of cables or rope lines 32 relative to the respective groove or channel 42 in the winding drum 40 associated therewith and are movable in and along the longitudinal extension of the rail 1 substantially parallel to the axis of rotation of the winding drum 40. Guide elements 3*a*, 3*b* are drivable by the rope lines 32 as they are wound onto and from the drum 40, and therefore require no additional drive means. Upper and lower support rollers or wheels 5*a*, 5*b*, respectively, are carried on the guide elements 3*a*, 3*b* to assist the driven longitudinal movement of the guide elements 3*a*, 3*b* along the tracks 2*a*, 2*b*. The support rollers 5*a*, 5*b* are supported in the tracks 2*a*, 2*b* for freewheeling rotation about a vertical axis of rotation. For guiding of the rope itself, a rope guide channel carrier 6 defining a rope guide channel 54 is fastened to each guide element 3*a*, 3*b*. Longitudinal coupling supports 7*a*, 7*b*, constructed as toothed racks having teeth 24 (FIG. 3) facing toward the center of rail 1 (i.e. facing toward the web 4), are rigidly connected to the guide elements 3*a*, 3*b*. In a preferred embodiment, the guide elements 3*a*, 3*b* are connected to an end of the longitudinal coupling support 7*a*, 7*b*. As seen in FIG. 1, the two coupling supports 7*a*, 7*b* are connected to one another by a toothed wheel 8 that is freely rotatable about a pin 9 (FIG. 3) mounted through an aperture in the rail 1. To facilitate the free rotation of the toothed wheel 8, the rail aperture is sized so as to accommodate radial play 9*a* of the pin 9 within the aperture, as shown more clearly in FIG. 3. The toothed wheel 8 can be inserted in virtually any position of the longitudinal coupling supports 7*a*, 7*b* relative to one another in the tracks 2*a*, 2*b*. The toothed engagement and relationship between the longitudinal coupling supports 7*a*, 7*b* and the toothed wheel 8 causes the guide elements 3*a*, 3*b* to be connected with one another for displacement in opposite directions as the rope lines 32 are wound onto and from the winding drum 40.

The longitudinal coupling supports 7*a*, 7*b* are supported at respectively opposite ends by running wheels 10*a*, 10*b* that are arranged for freewheeling rotation about horizontal axes in the tracks 2*a*, 2*b*. In addition, each longitudinal coupling support 7*a*, 7*b* is guided and supported in the tracks 2*a*, 2*b* so as to be displaceable in and along the longitudinal orientation of the rail 1 by way of a vertically supported and freely rotatable support roller 11*a*, 11*b*, each rotatable about a vertical axis. In a preferred embodiment, each support roller 11*a*, 11*b* is connected to an end of the corresponding longitudinal coupling support 7*a*, 7*b* remote from the end to which the respective guide element 3*a*, 3*b* is connected.

While the preferred embodiment includes two separate tracks 2*a*, 2*b* within which the various running wheels and support rollers guide and support the guide elements 3*a*, 3*b* and longitudinal coupling shafts 7*a*, 7*b*, it will be apparent to those of ordinary skill in the art that more than two tracks may be provided to accomplish the same result. For example, the support rollers 5*a*, 5*b* of the guide elements 3*a*, 3*b* and the support rollers 11*a*, 11*b* and running wheels 10*a*, 10*b* of the longitudinal coupling supports 7*a*, 7*b* may alternatively run in separately constructed tracks.

Figure 2:
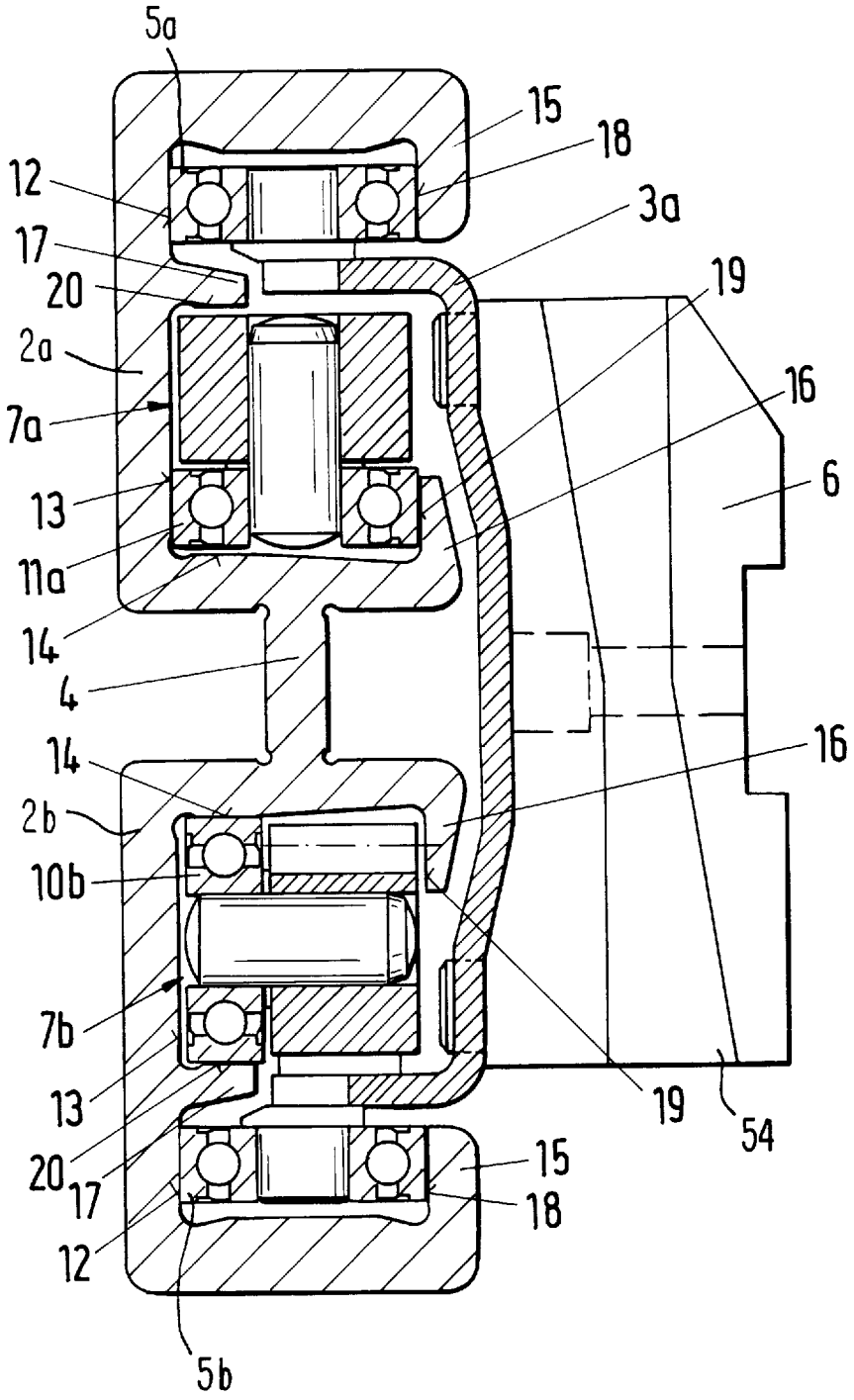
FIG. 2 is a cross-sectional view of the rail of FIG. 1 taken along the lines 2—2.

FIG. 2 depicts a cross-sectional view taken along the lines 2—2 in FIG. 1 and in which it can be seen that the tracks 2*a*, 2*b* form substantially vertical support surfaces 12, 13 and substantially horizontal support surfaces 14. In addition, the tracks 2*a*, 2*b* are configured to include holding elements 15, 16, 17 that form substantially vertically-oriented support surfaces 18, 19 and substantially horizontally-oriented running surfaces 20, all of which extend longitudinally within and along the rail 1. Running wheels 10*a*, 10*b* thus are supported and guided within holding elements 16, 17 and by support surfaces 13, 14 and running surface 20. Support rollers 5*a*, 5*b* are supported and guided within running element 15 and by support surfaces 18 and 12. Support rollers 11*a*, 11*b* are supported and guided within holding element 16 and by support surfaces 13, 19.

Figure 3:
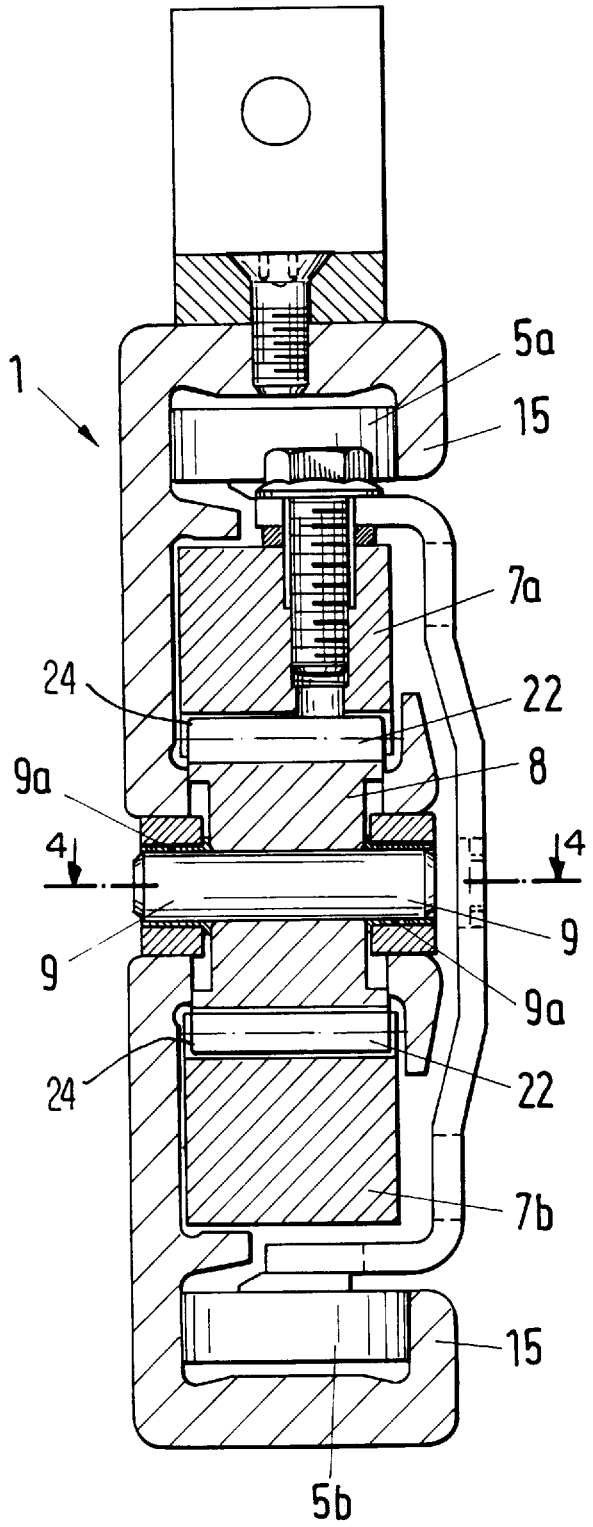
FIG. 3 is a cross-sectional view of the rail of FIG. 1 taken along the lines 3—3.

FIG. 3 shows a cross-sectional view of the rail 1 of the present invention taken along the lines 3—3 in FIG. 1. Clearly shown in FIG. 3 is the cross-section of the rail 1 in the region of the toothed wheel 8; thus, FIG. 3 in particular shows the cooperation of the teeth 22 of toothed wheel 8 with the teeth 24 of the longitudinal coupling supports 7*a*, 7*b* which are constructed as toothed racks. Pin 9 is carried with radial play 9*a* in the bore or aperture defined in rail 1 so that toothed wheel 8 is freely rotatable about the axis of rotation defined by pin 9. The teeth 22 of the toothed wheel 8 thus engage the teeth 24 at the bottom and top (as oriented in FIG.

Figure 4:
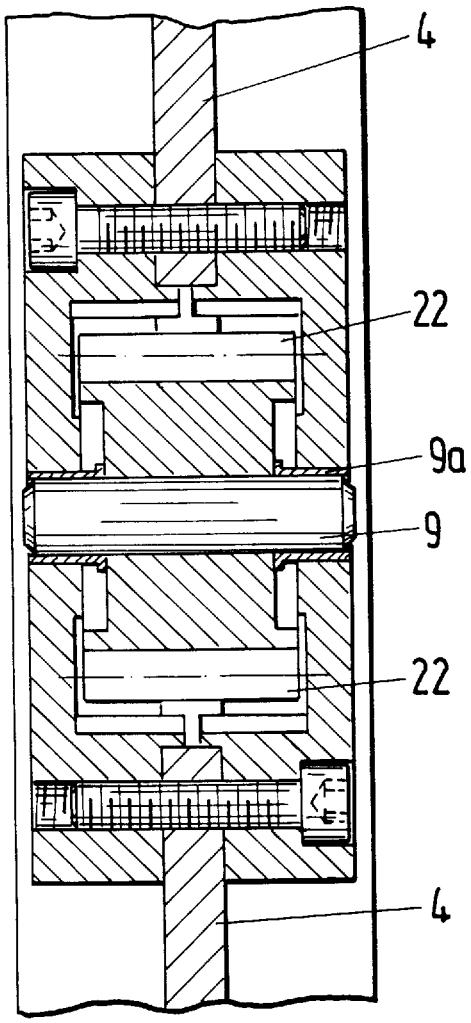
FIG. 4 is a longitudinal cross-sectional view of the rail of FIG. 3 taken along the lines 4—4.

3) of longitudinal coupling supports 7*a,* 7*b,* respectively so that the coupling supports 7*a,* 7*b* are horizontally fixed relative to one another. Consequently, the longitudinal coupling supports 7*a,* 7*b* also move horizontally relative to one another as the rope lines 32 are wound onto and from the winding drum 40 as a result of the toothed engagement between the teeth 22 of toothed wheel 8 and the teeth 24 of longitudinal coupling supports 7*a,* 7*b.* FIG. 4 further depicts the radial play 9*a* of pin 9.

Figure 5:
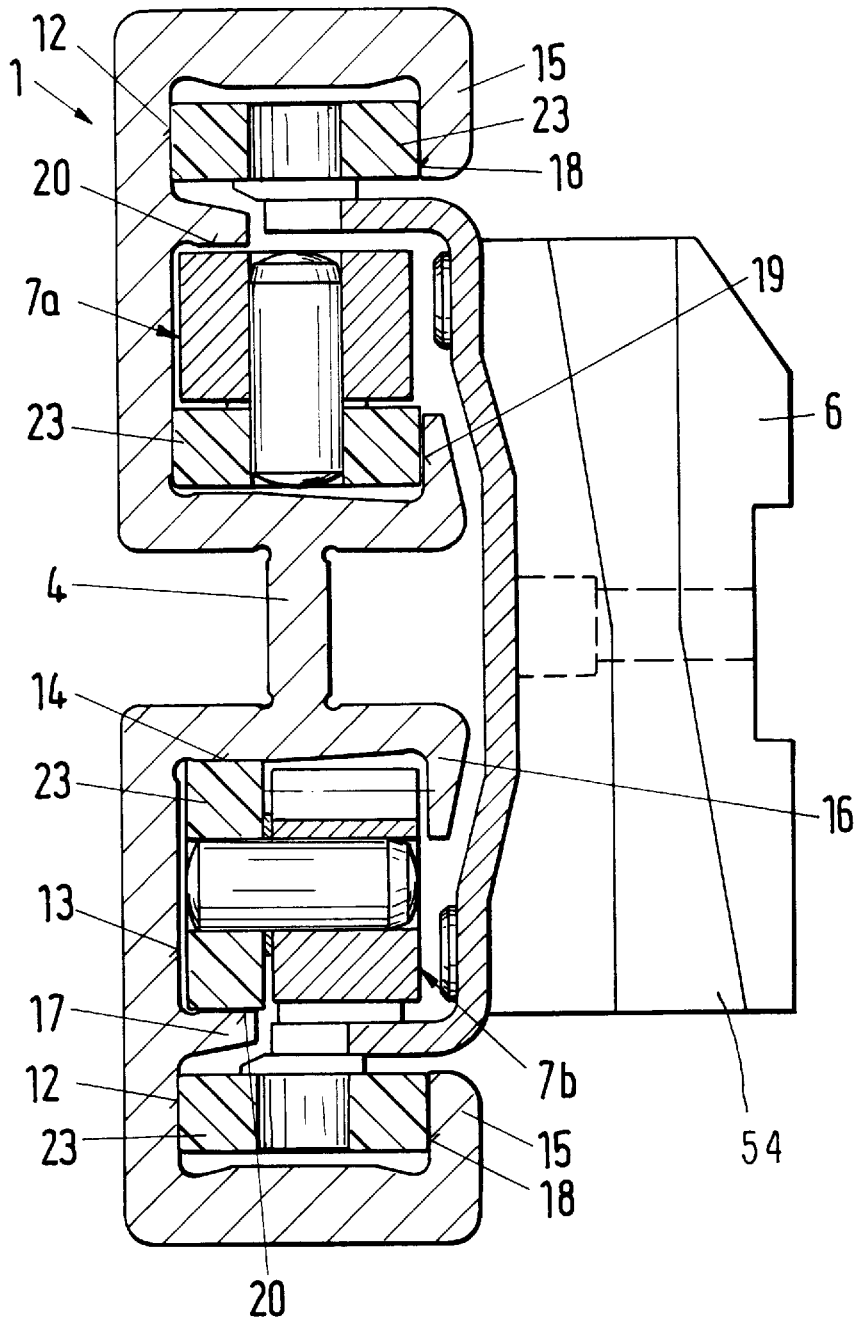
FIG. 5 is a cross-sectional view of the rail of FIG. 1 taken along the lines 2—2 but showing sliding elements in lieu of support rollers.

FIG. 5 shows a modified cross-sectional view taken along the lines 2—2 in FIG. 1 of an alternative embodiment of the rail 1. Sliding elements 23, having a substantially square cross-section, are provided in this modified embodiment in lieu of the running wheels 10*a,* 10*b* and support rollers 5*a,* 5*b,* 11*a,* 11*b* for supporting and guiding the coupling supports 7*a,* 7*b* and guide elements 3*a,* 3*b.* Of course, it is also within the intended scope and contemplation of the invention to replace the running wheels 10*a,* 10*b* and support rollers 5*a,* 5*b,* 11*a,* 11*b* only in part by sliding elements 23. In this alternative embodiment, guide elements 3*a,* 3*b* are also guided and supported by means of support surfaces 12, 13, 14, 18, 19 and running surface 20, wherein the sliding elements 23 slide along these support surfaces during movement of the guide elements 3*a,* 3*b.*

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rope guide for a winch including a winding drum supported for rotation about a drum axis and defining a drum periphery about which a pair of rope lines are windable onto and off of the winding drum as the drum is rotated about the drum axis and rope grooves helically defined in the drum periphery for receiving the rope lines as the lines are wound onto the drum, said rope guide comprising:

an elongated rail defining a first track and a second track extending longitudinally along said rail in spaced apart and substantially parallel relation to each other and to the drum axis;

a plurality of guide elements carried by said rail for movement longitudinally on and along said rail, said plurality of guide elements aligning the rope lines with the respective rope grooves as the rope lines are wound onto and off of the winding drum, said guide elements being drivable by the rope lines for movement longitudinally on and along said rail as the rope lines are wound onto and off of the drum, said guide elements being supported in said first and said second tracks; and coupling means for connecting said guide elements to each other and for concurrently displacing said guide elements in opposite directions from each other along said rail as the rope lines are wound onto and off of the winding drum by rotation of the winding drum;

said coupling means further comprising a plurality of longitudinal coupling supports concurrently movable in relatively opposite directions from each other along said rail and guidable in said first and said second tracks, each of said plurality of longitudinal coupling supports having longitudinally opposite ends and being supported in one of said first and said second tracks at at least two spaced apart points disposed in spaced apart relation, and being rigidly connected with one of said guide elements.

2. The rope guide of claim 1, further comprising a toothed wheel rotatably supported in said rail, each said longitudinal coupling support comprising a toothed rack operatively engaged with said toothed wheel so that said toothed wheel connects said plural longitudinal coupling supports.

3. The rope guide of claim 2, further comprising a pin for rotatably supporting said toothed wheel in said rail and an opening defined in said rail between said longitudinal coupling supports for receiving said pin in said opening so as to accommodate radial play of said pin in said opening.

4. The rope guide of claim 1, wherein each said longitudinal coupling support further comprises a plurality of freely rotatable running wheels disposed proximate said longitudinally opposite ends of said each coupling support for supporting said each coupling support in a respective one of said first and said second tracks.

5. The rope guide of claim 1, where each said longitudinal coupling support is rigidly connected with one of said guide elements at a first one of said longitudinal ends, and wherein each said coupling support further comprises a freely rotatable support roller disposed at an end opposite said first one of said longitudinal ends for guiding said opposite end of said coupling support in one of said first and said second tracks.

6. The rope guide of claim 1, further comprising two support rollers rotatably mounted on each of said plurality of guide elements for supporting each said guide element for movement in and along said first and said second tracks.

7. The rope guide of claim 1, wherein each of said first and said second tracks define a plurality of support surfaces for guiding and supporting said guide elements and said plurality of longitudinal coupling elements.

8. The rope guide of claim 1, wherein said tracks further comprise a plurality of holding elements defining a plurality of first surfaces oriented in a first direction and a plurality of second surfaces oriented in a second direction substantially transverse to said first direction, said first and second surfaces extending longitudinally along said rail.

9. The rope guide of claim 1, wherein each said longitudinal coupling support further comprises a plurality of sliding elements carried proximate said longitudinally opposite ends of said coupling support for slidingly supporting said coupling support for movement in and along a respective one of said first and said second tracks.

10. The rope guide of claim 1, wherein each said longitudinal coupling support is rigidly connected with one of said guide elements at a first one of said longitudinal ends, and wherein each said coupling support further comprises a sliding element disposed at an end opposite said first one of said longitudinal ends for slidingly supporting said opposite end of said coupling support in one of said first and said second tracks.

11. The rope guide of claim 1, further comprising two sliding elements on each of said plural guide elements for slidingly supporting said each guide element for movement in and along said tracks.

* * * * *